US006425447B1

(12) United States Patent
Bartette et al.

(10) Patent No.: US 6,425,447 B1
(45) Date of Patent: Jul. 30, 2002

(54) APPARATUS FOR HANDLING GEOLOGICAL SAMPLES

(75) Inventors: Pascal Bartette; Philippe Louis Cravatte, both of Aberdeen (GB)

(73) Assignee: Corpo Systems Limited, Whitecairns (GB)

( * ) Notice: Subject to any disclaimer, the term of this patent is extended or adjusted under 35 U.S.C. 154(b) by 0 days.

(21) Appl. No.: 09/596,401

(22) Filed: Jun. 16, 2000

(30) Foreign Application Priority Data

Jun. 17, 1999 (GB) ..... 9913974

(51) Int. Cl.[7] ..... E21B 49/00; E21B 25/06
(52) U.S. Cl. ..... 175/58
(58) Field of Search ..... 175/20, 58, 59, 175/226, 244, 249, 250, 251, 252, 253, 308, 403

(56) References Cited

U.S. PATENT DOCUMENTS 3,621,924 A 11/1971 Lebourg ..... 175/58
4,598,777 A 7/1986 Park et al. ..... 175/58
5,568,438 A 10/1996 Penchuk ..... 365/208
5,854,432 A 12/1998 Vollweiler et al. ..... 73/864.44

FOREIGN PATENT DOCUMENTS

DE 2 144 046 5/1972

*Primary Examiner*—Robert E. Pezzuto
(74) *Attorney, Agent, or Firm*—RatnerPrestia

(57) ABSTRACT

A method and apparatus for handling a geological sample, such as a core from a formation. The formation may be a formation of an oil and/or gas well. The apparatus includes a container for receiving the sample and is characterized in that the container comprises at least one wall with a surface which can change its configuration in response to pressure changes. The method of handling a geological sample obtained includes providing a container for receiving the sample. The container has a surface which is capable of changing its configuration in response to pressure changes. The sample is introduced into the container, and the configuration of the surface is changed to contact the sample. The container is then withdrawn from the formation.

24 Claims, 1 Drawing Sheet

4
5
1
10c
10

4
5
1
10c
10

10
10c
3

4
5
1

APPARATUS FOR HANDLING GEOLOGICAL SAMPLES

This invention relates to apparatus for handling material sampled from geological formations.

BACKGROUND OF THE INVENTION

During the drilling of bore holes as, for example, in the oil and gas industry, core samples are cut from the formation being drilled to obtain data. Such samples are commonly taken at the bottom of a bore hole during the drilling process by a core barrel which conventionally comprises a rigid outer tube disposed in the drill string above a core bit, and a thin flexible inner assembly located inside the outer tube. The drill string is lowered to the bottom of the well where the rotation of the string, downward force and fluid drives the core bit into the formation so that a core of the formation is forced into the outer tube and inner assembly. Core retainers usually in the form of spring catchers or fingers extend into the inner bore to trap it in place. The entire drilling assembly is then withdrawn from the hole to enable the core to be recovered and cut into suitable lengths for further study.

The handling procedures to recover the string and to cut the core into lengths involve stress and damage to the core, particularly in sandy formations, and this can reduce the value of the data recoverable.

SUMMARY OF THE INVENTION

According to the present invention there is provided apparatus for handling a geological sample, the apparatus comprising a container for receiving the sample and having at least one wall with a surface which can change its configuration in response to pressure changes.

The surface of the wall is preferably formed by a covering having trapped pockets of fluid, typically compressible fluid and preferably gas bubbles, which are trapped within a suitable matrix of, for example, foam or plastic. A suitable material for this purpose is conventionally available "bubble wrap" which comprises a layer of plastic sheet having gas-filled pockets formed thereon and held captive on the sheet. The pockets are flexible and at normal atmospheric pressure they are slightly turgid extending proud of the surface of the sheet by the volume of the gas trapped inside them. At higher atmospheric pressures the gas inside the pockets is compressed to a lower volume and the pockets are more flaccid, conforming more to the flat sheet.

The covering can be disposed over the whole surface of the container, or can be provided in discrete areas. The covering is preferably resilient and can adopt different configurations.

The container is preferably hollow, with the covering disposed on the inner surface. Alternatively, the container can have the covering disposed on an outer surface as long as it can bear against the core sample when in the container.

The container is preferably in the form of an open-ended cylinder.

The apparatus can be incorporated into a drill or coring string with a drill or coring bit.

The apparatus may incorporate an outer coring barrel around the container, or the container may itself serve as the outer coring barrel.

The covering can optionally comprise a high porosity and impermeable material that can be disposed on or attached to, or can be integral with the inner wall of the container. The covering may also be adapted to reduce friction coefficients, typically on the surface which in use contact the sample.

The expandable surface protects and supports the geological sample (eg the core) at the end of coring process while approaching the surface during the trip out of the hole. When expanded under atmospheric conditions, the surface reduces the diameter of the bore below the diameter of the core bit. When the apparatus enters the bore hole, the naturally increasing hydrostatic pressure applied by the drilling fluid (and/or optionally artificially applied increasing wellbore pressure from surface) will compress the surface and enlarge the inner diameter of the container so that when the apparatus reaches the formation to be sampled, the surface has compressed to leave a space in the container larger than the core to be cut by the core bit. The core can therefore be cut without the surface presenting any, or only minimal, obstacle to the core entering the container.

While pulling out of the hole the hydrostatic pressure on the apparatus will decrease, and the surface will expand to bear against the core trapped in the container, so as to isolate it from jars and other stress encountered during the extraction process which tend to affect the core's integrity.

The invention also provides a method of handling a geological sample, the method comprising;

providing a container for receiving the sample, the container having a surface which is capable of changing its configuration in response to pressure changes;

introducing the sample into the container;

changing the configuration of the surface to contact the sample; and withdrawing the container from the formation.

The method can be carried out downhole or on surface.

The method can usefully be carried out at surface, wherein a core can be held in the container having the foam, for example, on its inner surface while in a pressure vessel at an artificially lowered pressure, so that the foam expands and supports the core during handling or cutting of the container into lengths. The invention therefore encompasses such a pressure vessel in combination with the apparatus of the first aspect.

BRIEF DESCRIPTION OF THE DRAWINGS

Embodiments of the present invention will now be described, by way of example only, and with reference to the accompanying drawings, in which.

DESCRIPTION OF PREFERRED EMBODIMENTS

Figures 1A, 1B, 1C:
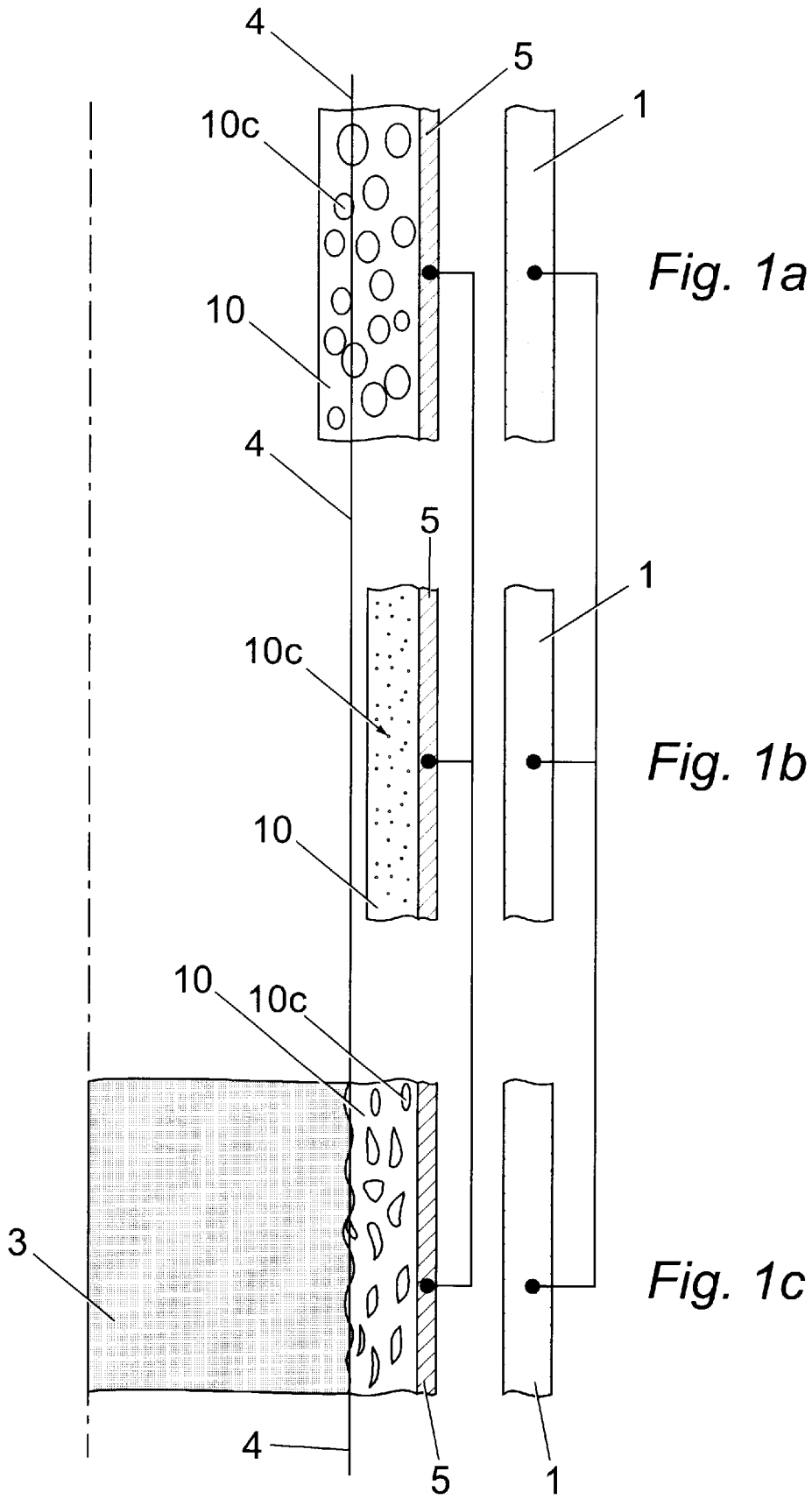
FIGS. 1(*a*), 1(*b*) & 1(*c*) show a series of side sectional views of a container embodying the invention at sequential points in handling a geological sample.

The apparatus shown in FIGS. 1(*a*), 1(*b*) & 1(*c*) comprises a rigid outer tube 1 forming a coring barrel 1 connected in a coring string (not shown) above a coring bit (not shown) which cuts a cylindrical core 3 of fixed diameter 4 into a formation being sampled. The outer tube 1 surrounds and carries a smaller diameter inner tube 5 which is wider than the core 3 and which receives and contains the core 3 within it's bore. The inner tube 5 is preferably slightly flexible and is aligned with the core bit so that, after the core 3 is cut, it is delivered into the bore of the inner tube 5.

The inner surface of the inner tube 5 is completely covered with foam 10 having closed cells 10*c* filled with gas, such as air, and trapped within the foam 10. At the surface of the well when the foam 10 is at atmospheric pressure, the air pressure in the cells 10*c* keeps them turgid and the foam covering 10 is in an expanded state so that the inner diameter of the bore is less than the core diameter 4 (typically about 3% less).

As the apparatus is lowered into the well, the hydrostatic pressure of the wellbore fluid and the natural increase in the pressure arising from the depth of the wellbore compresses the gas in the cells 10*c*, which collapse, and the foam layer 10 is compressed against the inner surface of the inner tube 5 so that the inner diameter of the bore increases beyond the diameter of the bore bit 4. This collapsing process can occur gradually as the apparatus is lowered deeper, and the foam cell 10*c* characteristics and pressure can initially be selected to collapse the cells 10*c* at a certain depth of well.

Alternatively (and preferably) the cells 10*c* can be collapsed solely by increasing hydrostatic pressure on the apparatus (e.g. in the wellbore) which can be controlled remotely, e.g. from the surface, so that the collapsing of the cells 10*c* and associated reduction in the bore diameter can be triggered by pressure increases applied to the wellbore from surface when the core 3 is being cut. At the moment that the barrel 1 reaches the bottom of the hole and the foam 10 has collapsed, the inner diameter is preferably a minimum of 3 to 5% larger than the size of the core 3 to be cut.

After the cells 10*c* have collapsed and the foam 10 has adopted the configuration shown in FIG. 1*b*, the core 3 can be cut with the bit and the core 3 conveyed into the bore of the inner tube 5 without obstruction by the foam 10. The core 3 is cut as in a conventional coring process, for example, by applying weight, rotation and flow to the core bit.

After the core sample 3 has been cut and conveyed into the bore, the core retainer (not shown and optional) can be operated to trap the core 3 and the apparatus can then be extracted from the wellbore. If the apparatus is being run under artificially increased pressure then at this point, it is preferable that the wellbore pressure is decreased, for example from surface, so that the cells 10*c* expand under their own internal pressure to change the diameter of the foam layer 10 to the position shown in FIG. 1(*c*), where the outer edge of the core 3 is engaged and supported by the inner edge of the foam 10.

Alternatively, if the pressure changes used to drive the expansion are natural pressure changes as the apparatus is recovered from the wellbore, the natural decrease in pressure on the foam 10 can be used to cause the expansion of the foam layer 10 without any external pressure changes being applied.

The core 3 is therefore gently wrapped inside the foam 10. Damage relating to mechanical disturbances during the recovery, handling and processing can be reduced as a result. Furthermore, because the foam 10 can conform closely to the outer surface of the core 3, air contamination is also reduced further improving the core 3 quality.

In certain embodiments the surface can be adapted to expand to different extents by providing additional layers of cells 10*c* which can, in their compressed state, still retract to a diameter less than the core diameter 4, but when expanded, can extend into the bore of the container to restrain the core sample 3 against longitudinal movement.

The embodiment shown in the Figs. uses foam 10 but other types of expandable surface 10 are well within the scope of the invention; in particular, bubble wrap can be used instead of foam.

Modifications and improvements can be incorporated without departing from the scope of the invention.

What is claimed is:

1. Apparatus for handling a geological sample, the apparatus comprising a container for receiving the sample, characterised in that the container comprises at least one wall with a surface which can change its configuration in response to pressure changes, said wall comprising a matrix formed from an impermeable material and which traps compressible fluid.

2. An apparatus according to claim 1, wherein the compressible fluid comprises gas bubbles.

3. An apparatus according to claim 1, wherein the matrix of the wall is formed from foam.

4. An apparatus according to claim 1, wherein the matrix of the wall is formed from plastic.

5. An apparatus according to claim 4, wherein the matrix comprises a layer of plastic sheet having gas-filled pockets formed thereon and held captive on the plastic sheet.

6. An apparatus according to claim 5, wherein the pockets are flexible and at normal atmospheric pressure they extend the surface of the wall by the volume of the gas trapped therein.

7. An apparatus according to claim 1, wherein, at higher atmospheric pressures, the gas inside the pockets is compressed to a lower volume and the pockets conform substantially to the surface of the wall.

8. An apparatus according to claim 1, wherein the matrix is disposed over the whole surface of the container.

9. An apparatus according to claim 1, wherein the matrix is provided in discrete areas of the container.

10. An apparatus according to claim 1, wherein the matrix is resilient.

11. An apparatus according to claim 1, wherein the container is hollow, and the matrix is disposed on the inner surface of the container.

12. An apparatus according to claim 1, wherein the matrix is disposed on an outer surface of the container such that the matrix is capable of bearing against the sample when received within the container.

13. An apparatus according to claim 1, wherein the container is in the form of an open-ended cylinder.

14. An apparatus according to claim 1, wherein the apparatus is incorporated into a drill or coring string with a respective drill or coring bit.

15. An apparatus according to claim 1, wherein the apparatus further comprises an outer coring barrel arranged around the container.

16. An apparatus according to claim 15, wherein the container itself serves as the outer coring barrel.

17. An apparatus according to claim 1, wherein the matrix further comprises a high porosity material that is at least one of disposed on, or attached to, or integral with, an inner wall of the container.

18. An apparatus according to claim 1, wherein the matrix is adapted to reduce the friction coefficients on the surface which in use contacts the sample.

19. An apparatus according to claim 14, wherein the surface is an expandable surface and is adapted to protect and support the geological sample at the end of handling process while approaching a borehole surface during a trip out of a borehole.

20. An apparatus according to claim 19, wherein when the surface is expanded under atmospheric conditions, the surface reduces the diameter of a bore of the apparatus below the diameter of the coring bit.

21. An apparatus according to claim 20, wherein when the apparatus enters the bore hole, an increasing pressure compresses the surface and enlarges the inner diameter of the container so that when the apparatus reaches the geological sample, the surface has compressed to leave a space in the container larger than a core to be cut by the coring bit.

22. An apparatus according to claim 21, wherein when pulling out of the borehole, the pressure on the apparatus will decrease, and the surface will expand to bear against the sample received in the container, so as to isolate it from stresses encountered during the extraction process which tend to affect the sample's integrity.

23. A method of handling a geological sample obtained from a formation, the method comprising;

providing a container for receiving the sample, the container having a surface which is capable of changing its configuration in response to pressure changes, wherein the surface is provided on a matrix formed from an impermeable material and which traps compressible fluid;

introducing the sample into the container; and withdrawing the container from the formation such that the configuration of the surface changes to contact the sample.

24. A method according to claim 23, wherein the method is carried out at surface, and a sample is held in the container while in a pressure vessel at an artificially lowered pressure, so that the surface supports the sample during handling or cutting of the container into lengths.

* * * * *